US006192065B1

(12) United States Patent
Ferreira et al.

(10) Patent No.: US 6,192,065 B1
(45) Date of Patent: Feb. 20, 2001

(54) METHOD AND APPARATUS FOR CONTROLLING ARCING IN A DC ARC FURNACE

(76) Inventors: Jan Abraham Ferreira, Wethouder Verheulplantsoen 6, 2289 KE Rijswijk (NL); Anthony Wayne Wewege, 30 Raven St., Saldanha (ZA)

( * ) Notice: Under 35 U.S.C. 154(b), the term of this patent shall be extended for 0 days.

(21) Appl. No.: 09/428,919

(22) Filed: Oct. 28, 1999

(30) Foreign Application Priority Data

Oct. 28, 1998 (ZA) ..... 98/9803

(51) Int. Cl.[7] ..... H05B 7/144
(52) U.S. Cl. ..... 373/108; 373/104
(58) Field of Search ..... 373/102, 104, 373/108

(56) References Cited

U.S. PATENT DOCUMENTS

| | | | | |
|---|---|---|---|---|
| 3,385,920 | | 5/1968 | Harbaugh et al. . | |
| 3,929,456 | | 12/1975 | Kibby . | |
| 3,937,869 | | 2/1976 | Markarian et al. . | |
| 4,063,028 | | 12/1977 | Longenecker . | |
| 4,273,949 | | 6/1981 | Fisher et al. . | |
| 4,677,643 | | 6/1987 | Dicks . | |
| 4,881,239 | | 11/1989 | Stenzel et al. . | |
| 5,009,703 | | 4/1991 | Arvidson et al. . | |
| 5,239,554 | * | 8/1993 | Gensini et al. | 373/102 |
| 5,351,267 | * | 9/1994 | Strebel | 373/105 |
| 5,368,627 | | 11/1994 | Cowx . | |
| 5,438,588 | * | 8/1995 | Wanner | 373/108 |
| 5,463,653 | * | 10/1995 | Du Parc et al. | 373/108 |
| 5,533,044 | * | 7/1996 | Strebel | 373/104 |
| 5,610,937 | * | 3/1997 | Gaupp | 373/108 |
| 5,617,447 | * | 4/1997 | Tambe | 373/108 |
| 5,737,355 | * | 4/1998 | Damkroger | 373/50 |

* cited by examiner

*Primary Examiner*—Tu Ba Hoang
(74) *Attorney, Agent, or Firm*—Jones, Tullar & Cooper PC

(57) ABSTRACT

In the operation of a dc arc furnace components of the furnace are monitored to detect unwanted arcs. A first low impedance path is continuously established between the components. When an arc is detected a second conductive path of a predetermined impedance is established between the components, in parallel to the first low impedance path, to extinguish the arc. After the arc has been extinguished the second path is open circuited to restore the furnace to normal operation.

18 Claims, 5 Drawing Sheets

METHOD AND APPARATUS FOR CONTROLLING ARCING IN A DC ARC FURNACE

BACKGROUND OF THE INVENTION

This invention is concerned generally with controlling the operation of a DC arc furnace and is more particularly concerned with controlling and limiting the incidence of arcing between furnace components.

The processes which give rise to unwanted arcing between furnace components in a DC arc furnace are not readily understood nor predictable. A voltage gradient should however be established between various components of the furnace in such a way that the voltage difference between any two components is below a threshold voltage at which arcing could occur.

The threshold voltage is dependent on a number of variable parameters. Also the voltage between any two components may also be affected by operating conditions. Consequently although a particular voltage difference between two components of a furnace may not, initially, be in excess of the relevant threshold voltage the operating conditions may change in such a way that the threshold voltage is in fact exceeded and arcing occurs.

The effect of unwanted arcing can be catastrophic. It is essential therefore to detect an arc as soon as possible after it occurs and to take action to extinguish the arc.

Although the incidence of arcing can be minimised by operating a furnace at rated power with a low voltage and high current it is difficult to justify this type of approach on economic grounds. On the contrary it is desirable to operate a furnace at its rated power output with a high voltage but under operating conditions such that arcing is unlikely to occur. If however unwanted arcing does take place action must be initiated as soon as possible to limit damage and thereafter to restore the furnace to an effective operating situation so that down-time is reduced.

SUMMARY OF THE INVENTION

The invention provides a method of controlling and limiting the incidence of arcing in a DC arc furnace which includes the steps of establishing a first path with a low impedance between at least two components of the furnace, monitoring the components to detect an unwanted arc between the components and, when an arc is detected, of establishing a second path with a predetermined impedance between the components, in parallel to the arc, to extinguish the arc.

Thus the arc is extinguished by reducing the voltage across the arc.

The method may include the step of reducing the impedance of the first path from a first impedance value to a second impedance value. The second impedance value is preferably approximately equal to the said predetermined impedance.

The low impedance path may be a low resistance path.

The components may be monitored by monitoring at least one of the following: the voltage between the components; the current between the components, and any combination thereof.

The existence of an unwanted arc between the two components may be indicated by a decrease, of a predetermined magnitude, of the voltage between the components, or an increase, of a predetermined magnitude, of the current between the components, or a change in any other electrical property.

The rate of change of the voltage, or the current, or other electrical property between the two components may also be used to indicate the existence of an unwanted arc.

After the arc has been extinguished the method may include the steps of removing the second path and then increasing the impedance of the first path from the second impedance value to the first impedance value, while maintaining the voltage across the components below a threshold value at which arcing occurs.

The impedance of the first path may be increased in a gradual manner which is consistent with the establishment of a high operating power level of the furnace whilst maintaining a reduced likelihood of unwanted arcing taking place.

The second path may be open circuited when the impedance of the first path is reduced to the second impedance value. The impedance of the first path may be varied if unwanted arcing continues to occur.

The aforesaid method may be used, substantially independently, with different sets of components of the furnace. Thus the method may be used for controlling the occurrence of unwanted arcs between the electrode of the furnace and a furnace seal; between the electrode and a centre ring of the furnace; and between the electrode and one or more conductive pins which are embedded in the roof of the furnace.

Arcing may also occur between the furnace seal and the centre ring. Thus, more generally, the method may be used to provide protection against arcing between any two components even if the voltage between the components is not measured directly but is calculated in some other way.

The use of conductive pins, in the furnace roof, is described for example in the specification of South African patent application No. 97/11080 and for this reason this aspect is not further elaborated on herein.

The invention also extends to apparatus for controlling and limiting the incidence of arcing in a DC arc furnace which includes means for establishing a first path with a low impedance between at least two components of the furnace, means to detect the existence of an unwanted arc between the components, and means responsive to the detecting means for establishing a second path with a predetermined impedance between the components, when an arc is detected, to extinguish the arc.

The detecting means may be responsive to at least one of the following: the voltage between the components; the current between the components.

The detecting means may be responsive to a change, of a predetermined magnitude, in the voltage or the current between the components, as the case may be, or in both parameters. Such change is indicative of the occurrence of an unwanted arc.

The detecting means may be responsive to the rate of change of the voltage or the current or, again, of both these parameters.

The means for establishing the said first path may include switch means and an impedance of low value and high power handling capability.

The switch means may operate at a high frequency. The said low value impedance may be a variable and controllable impedance.

The apparatus may include means for increasing the impedance of the said low value impedance, in a controlled manner, so that once the arc between the components has been extinguished the voltage across the components may be increased to a value which is consistent with a high power operating level of the furnace under operating conditions which do not readily give rise to the generation of unwanted arcing.

The apparatus may be employed for controlling the occurrence of unwanted arcing between the electrode of the furnace and a seal of the furnace; between the electrode and a centre ring of the furnace; between the electrode and one or more conductive pins which are embedded in the roof of the furnace and to which reference has been made hereinbefore, and between any two other components of the furnace.

BRIEF DESCRIPTION OF THE DRAWINGS

The invention is further described by way of example with reference to the accompanying drawings in which.

DESCRIPTION OF PREFERRED EMBODIMENT

Figure 1:
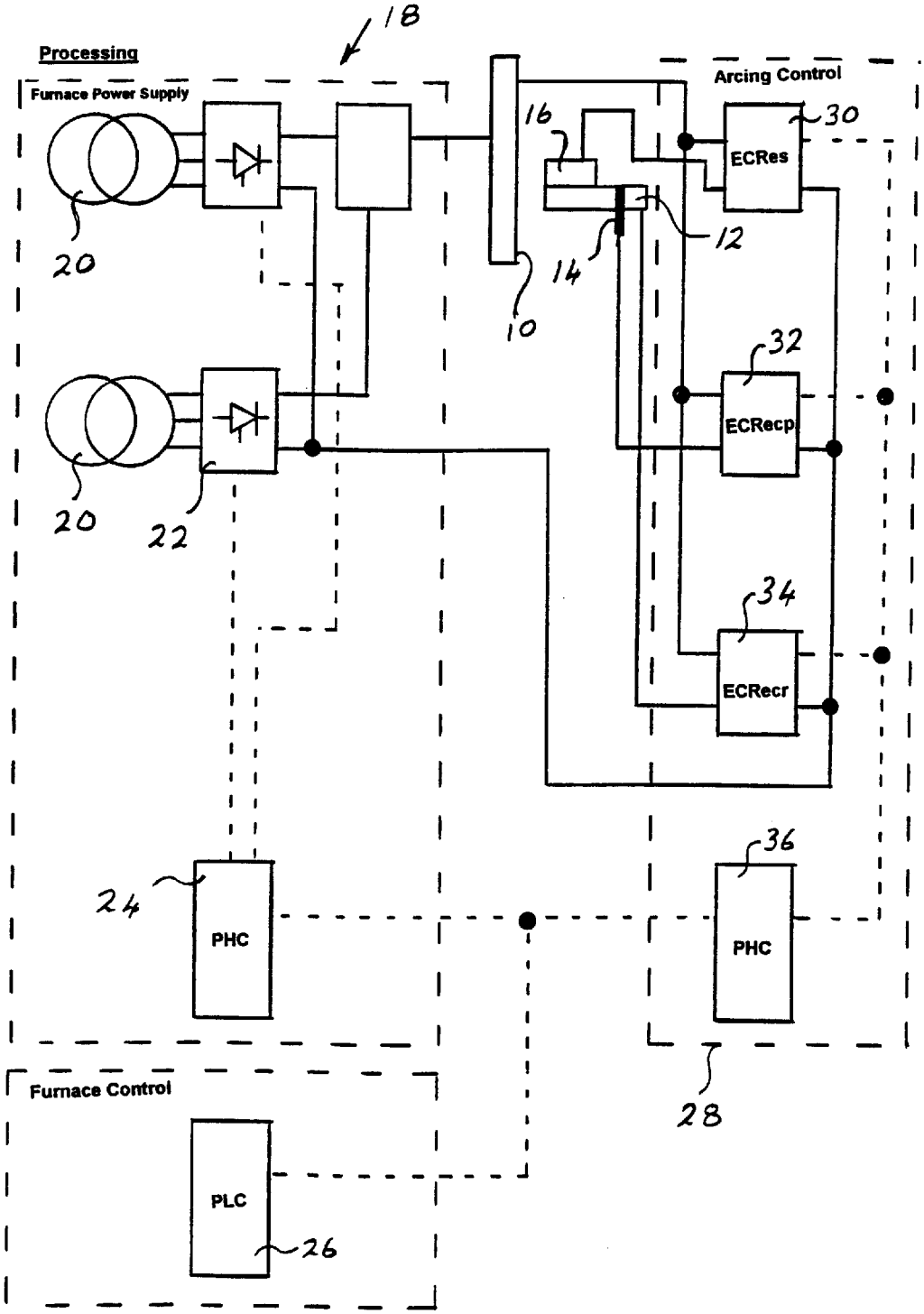
FIG. 1 is a block diagram of a furnace with control apparatus according to the invention.

FIG. 1 of the accompanying drawings illustrates, in block diagram form, certain components of a DC arc furnace and supply and control equipment.

The drawing schematically depicts an electrode 10, a centre ring 12 which forms part of a roof of the furnace, an electrically conductive copper pin 14 which is one of a plurality of similar pins embedded in the centre ring or in the roof of the furnace, and an electrode seal 16.

The construction of the furnace is known in the art and for this reason is not further described herein.

The use of electrically conductive copper pins, embedded in the furnace roof is described in the specification of South African patent application No. 97/11080.

The furnace is supplied with power by means of a power supply unit 18. Power drawn from a mains supply 20 is rectified in a controlled manner by rectifiers 22 and the DC output is applied to the electrode 10 and the hearth, not shown, of the furnace.

The rectifiers are controlled by a programmable high speed controller 24.

The operation of the furnace is under the control of a programmable logic controller 26. The controller 26 acts in a known manner and for this reason its operation is not further described herein.

Unwanted arcing can take place in the furnace principally between the electrode 10 and the seal 16; between the electrode and the conductive pin or pins 14; and between the electrode 10 and centre ring 12. It is to be noted that arcing can also take place between other components, for example between the seal 16 and the conductive pin 14. The incidence of this type of arcing is however relatively low but nonetheless the principles of the invention are applicable thereto in order to control such unwanted arcing.

Arcing between the electrode and the seal, the conductive pin, and the centre ring, is controlled by means of arcing control apparatus 28. This apparatus includes three electrically controllable resistors designated ECR-es, ECR-ecp and ECR-ecr, respectively, and labelled 30, 32 and 34 respectively. The electrically controllable resistors are, in turn, under the control of a suitable controller which may be a programmable low speed or high speed controller 36.

Figure 2:
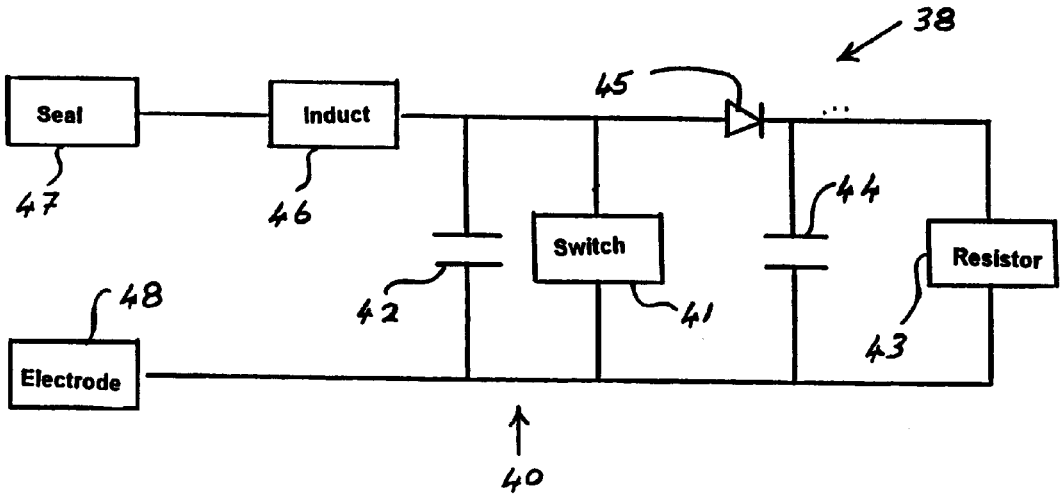
FIG. 2 is a block diagram of an electrically controllable resistance which is used in the control apparatus of the invention.

FIG. 2 is a block diagram representation of an electrically controllable resistor 38 which includes a network 40, with a high speed electronic switch 41 which is connected in parallel to a capacitor bank 42. A high power resistor 43 and capacitor 44 are in parallel and are connected through a rectifier 45 across the network 40. The circuit is connected via an inductor 46 to a furnace seal 47 and electrode 48.

When the switch 41 is off the current from the seal 47 flows through the diode 45 and the resistance between the seal and the electrode is equal to the value of the resistor 43 which is about 50 ohms. If the switch 41 is opened and closed with an increasing frequency the value of the impedance presented by the capacitor 44 decreases and hence the resistance value between the seal and the electrode reduces.

The effective impedance value of the electronically controllable resistor 38 is the value of the resistor 43 and the capacitor 44 in parallel and consequently, by controlling the frequency of operation of the switch 41 it is possible to control, in an electronic manner, the effective resistive value of the resistor 38. The preceding description of the resistor 38 is representative of the operation of each of the electrically controllable resistors 30, 32 and 34.

Figure 3:
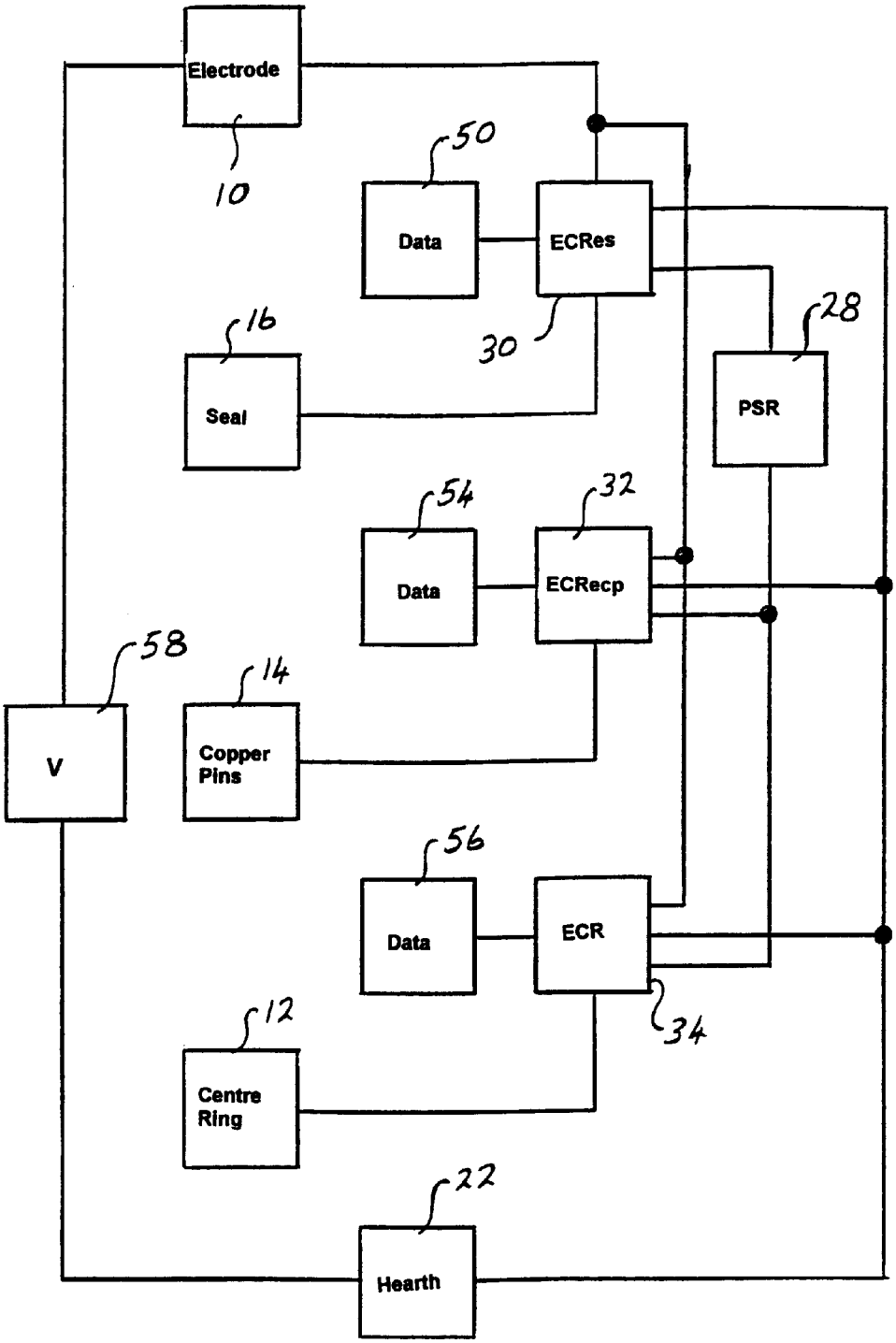
FIG. 3 illustrates in more detail the control apparatus which is incorporated in the arrangement of FIG. 1.

FIG. 3 shows the arcing control circuit of FIG. 1 and certain components of the furnace. The electronically controllable resistor 30 is connected between the electrode and the electrode seal and is supplied with reference data 50 (see FIG. 4), as is hereinafter described. The resistor 30 is also connected to a hearth 52 of the furnace. In a similar way reference data 54 is supplied to the electrically controllable resistor 32 and reference data 56 is applied to the resistor 34. The resistors 32 and 34 are also connected to the hearth 52. The furnace supply voltage 58 is applied across the electrode 10 and the hearth 52.

Figure 4:
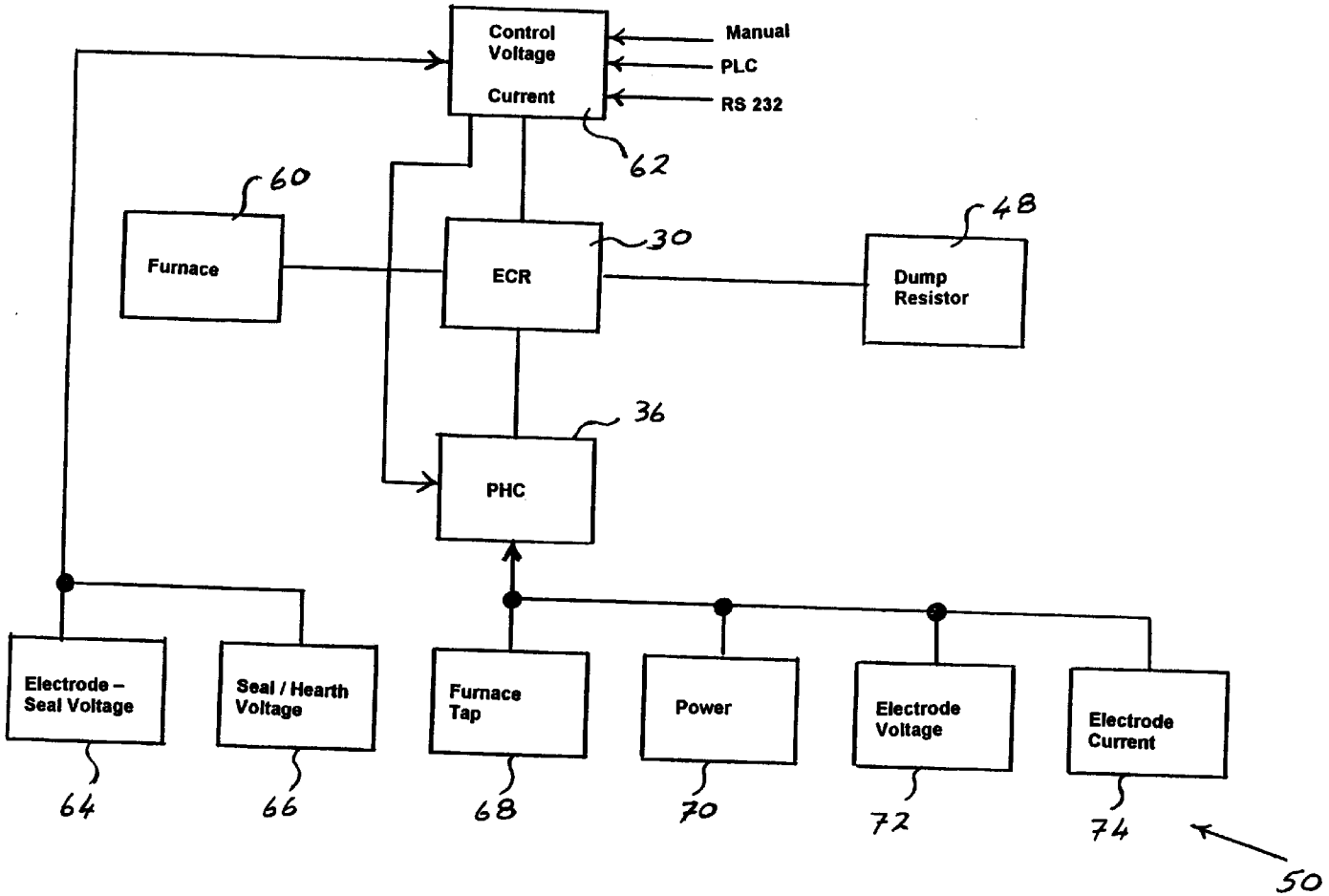
FIG. 4 is a block diagram representation of an electrically controllable resistor and control parameters, as used in the apparatus of the invention.

FIG. 4 illustrates the electrically controllable resistor 30 and the reference data 50 which applies to this resistor. It is to be understood that the resistor 30 has been chosen merely by way of example and that similar considerations apply to the resistors 32 and 34.

The DC arc furnace is schematically represented and is labelled with the reference numeral 60. The resistor 30 is controlled by means of a control unit 62 and control settings of the unit are applied to the programmable high speed controller 36. The controller 36 receives the reference data 50 from at least the following sources: the electrode seal voltage 64; the seal to hearth voltage 66; the furnace transformer tap position 68; the furnace power 70; the electrode voltage 72 and the electrode current 74.

The control unit is used for controlling the voltage and the current of the electrically controllable resistor 30. To this end use may be made of manually operable devices such as variable resistors, which are provided on the control unit, a control algorithm which is applied to the control unit from a computer which is connected to a communications port on the control unit, or a programmable logic controller.

The control parameters of the electrically controllable resistor 30 depend on its rating and on the system resistance between the connected components. The system resistance is dynamic and the value of the system resistance at any time determines the control parameter limits.

Critical parameters are the electrode to seal voltage and the seal to hearth voltage. These two parameters are shown in FIG. 6, as a function of time, during the onset and extinguishing of an arc between the electrode and the seal.

Figure 5:
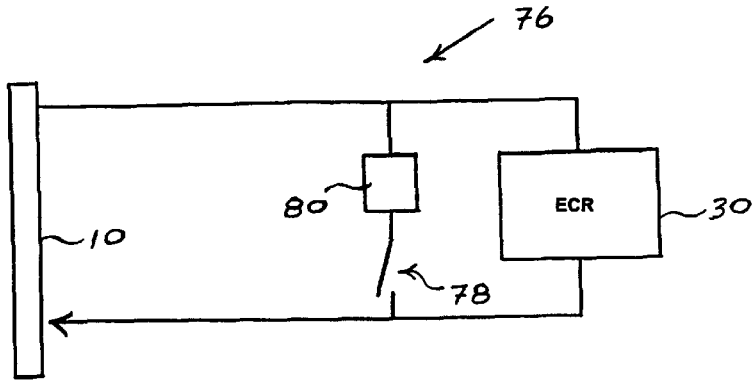
FIG. 5 illustrates an arrangement for extinguishing an unwanted arc between components of a DC arc furnace.
Figure 6:
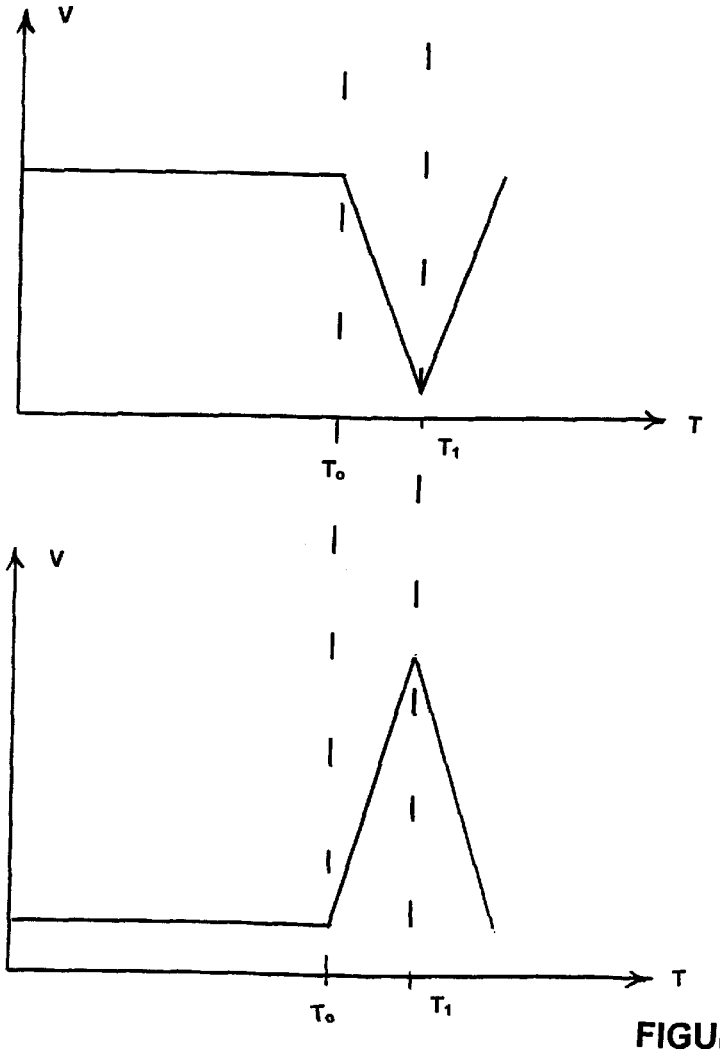
FIG. 6 depicts curves of voltage against time during the detection and extinguishing of an unwanted arc in a DC arc furnace.

The upper curve in FIG. 6 shows the electrode to seal voltage as a function of time. At time $T_0$ the voltage commences decreasing with a rapid rate of change. The curve in FIG. 6 shows that the seal to hearth voltage commences increasing with a rapid rate of rise, at time $T_0$. These changes indicate that an unwanted arc has been established between the electrode and the seal. By using the arrangement shown in FIG. 5, and described hereinafter, the arc is extinguished at a time $T_1$ and thereafter the voltage across the electrode and the seal is gradually increased to a safe operating value.

FIG. 5 shows the electrode 10 and the electrode seal 16. An arc extinguishing circuit 76 is connected across the components 10 and 16 and to the electrically controllable resistor 30.

The circuit 76 works in conjunction with the resistor 30 or forms part of the resistor. The circuit contains a high speed switch 78 and a current limiting resistor 80. The switch may be of a mechanical or solid state construction.

When an arc is detected across the electrode and the seal then the voltage across these components dips in the manner shown in FIG. 6. The decrease in the voltage and the rate of decrease are monitored and the switch 78 is closed so that the resistor 80 is connected across the components 10 and 16. The resistor has a low value and offers a low value impedance path in parallel to the path of the arc. Current flow is therefore diverted to the resistor and the arc is extinguished.

Once the arc has been extinguished the voltage and current reference values of the resistor 30 are adjusted. The voltage reference value is set at a relatively low level while the current reference value is set to a relatively high level. The switch 78 is then opened so that the low resistance path established by the resistor 80 is removed and effectively is replaced by a low resistance path created by the resistor 30.

There are two control loops. One is the voltage control loop and the other the current control loop. These control loops are controlled independently. Voltage control is used to control the voltage, for example from the electrode to the seal. By setting the voltage reference higher or lower the electrode to seal voltage is raised or lowered.

Current control is used to act as a current limit for the electrically controllable resistor. If the current limit is high then the current will not be limited and the voltage can be controlled throughout the range. If the current limit is reduced a point will be reached where the current allowed by the current controller will be insufficient to produce the desired voltage set-point.

As indicated it is desirable to operate at high, ie. rated, furnace power, with a high furnace voltage and a low electrode to seal voltage. Thus the voltage 64 between the electrode and the seal is reduced to a level which is below the threshold voltage, at which unwanted arcing takes place, while operating at a high power level.

The voltage between the electrode and the various components of the furnace must be graded so that the voltages are too low to cause unwanted arcing or, if unwanted arcing does occur, are too low to sustain such arcing. The voltage grading levels must be variable so that they can be adjusted to take account of changing furnace conditions. Thus the controller 3 6 must continuously monitor and grade the voltages to the optimum levels for the prevailing furnace conditions.

The voltage gradings are different for each transformer tap position and furnace operating point and depend on the condition of the furnace insulation between components of the furnace. The type of centre ring used also influences the grading.

Only by way of example if the electrode to hearth voltage is 520 volts then the electrode to centre ring voltage is 400 volts and the electrode to seal voltage is 80 volts.

It is possible that the furnace arc, which is equivalent to the current flow between the electrode and the hearth, may be lost momentarily. If this happens then the voltage grading would be incorrect as the furnace voltage has changed. The controller 36 can automatically adjust the voltage grading to take account of the prevailing voltages in the furnace and, thereafter, the voltage grading can be re-adjusted as the furnace voltage is recovered.

Similar action is called for if frothing takes place in the furnace.

Although unwanted arcing is rare during furnace start up the electronically controllable resistors may also be used to control arcing which may take place at this time.

For emergency stop conditions or for an orderly shut down of the furnace the electronically controllable resistors are operated to increase the voltage reference to a maximum ie. the resistance between the electrode and seal is restored to 50 ohms, and the current limit is taken to a minimum, to ensure that the electrically controllable resistor is in current limit, preventing the switch from operating.

The current which actually flows through each electronically controllable resistor is monitored to ensure that the amplitude of the current is not so high that damage to the furnace components occurs. For example under normal operating conditions voltages are established across the components of the furnace and these voltages require current to flow. The value of such current should be limited to a practical level.

The function of each electronically controllable resistor is to establish a suitable voltage across the respective furnace components to protect against arc damage. However system insulation levels could deteriorate to such an extent that the resistance across which a voltage is established by an electronically controllable resistor requires an excessive current to flow. Thus the current which is established by an electronically controllable resistor should be monitored to ensure that the current is compatible with the condition of the furnace.

Referring to FIGS. 2 and 5 the resistor 43 establishes a first path with a low impedance across the electrode and seal. The switch 41, acting with a controlled and variable frequency on the capacitor 44, can be used to reduce the effective value of the impedance presented by the resistor which is in parallel to the capacitor. The switch 78 when closed, establishes a second path with a predetermined impedance set by the resistor 80 in parallel to the first path. When an arc is detected the impedance of the first path is reduced and the second path is established, to extinguish the arc. When the arc is removed the second path is removed and the impedance of the first path is increased to its original value.

If unwanted arcing continues to occur the impedance of the first path ie. the resistor 44 and capacitor 43 in parallel, is reduced to a value which reduces the voltage across the electrode and seal below the threshold value at which arcing occurs.

What is claimed is:

1. A method of controlling and limiting the incidence of arcing in a DC arc furnace which includes the steps of establishing a first path with a low impedance between at least two components of the furnace, monitoring the components to detect an unwanted arc between the components and, when an arc is detected, establishing a second path with a predetermined impedance between the components, in parallel to the arc, to extinguish the arc.

2. A method according to claim 1 wherein the components are monitored by monitoring at least one of the following: the voltage between the components; the current between the components.

3. A method according to claim 1 which includes the step of reducing the impedance of the first path from a first impedance value to a second impedance value.

4. A method according to claim 3 wherein the first path is a low resistance path.

5. A method according to claim 3 which includes the step, after the arc has been extinguished, of removing the second path and then increasing the impedance of the first path from the second impedance value to the first impedance value, while maintaining the voltage across the components below a threshold value at which arcing occurs.

6. A method according to claim 5 wherein the impedance of the first path is increased in a gradual manner which is consistent with the establishment of a high operating power level of the furnace whilst maintaining a reduced likelihood that an unwanted arc between the components will occur.

7. A method according to claim 5 wherein the second impedance value is approximately equal to said predetermined impedance.

8. A method according to claim 7 wherein the second path is open circuited when the impedance of the first path is reduced to the second impedance value.

9. A method according to claim 1 which includes the step of varying the impedance of the first path if unwanted arcing continues to occur.

10. A method according to claim 1 which is used for controlling the occurrence of unwanted arcs between components of the furnace selected at least from the following:

(a) the electrode of the furnace and a furnace seal;

(b) the electrode and a centre ring of the furnace; and (c) the electrode and conductive pins which are embedded in the roof of the furnace.

11. Apparatus for controlling and limiting an incidence of arcing in a DC arc furnace which includes means for establishing a first path with a low impedance between at least two components of the furnace, means to detect the existence of an unwanted arc between the components, and means responsive to the detecting means for establishing second path with a predetermined impedance between the components, when an arc is detected, to extinguish the arc.

12. Apparatus according to claim 11 wherein the detecting means is responsive to at least one of the following: the voltage between the components; the current between the components.

13. Apparatus according to claim 11 wherein the detecting means is responsive to a change, of a predetermined magnitude, in the voltage or the current between the components, which is indicative of the presence of an unwanted arc.

14. Apparatus according to claim 13 wherein the detecting means is responsive to the rate of change of the voltage or the current between the components.

15. Apparatus according to claim 11 wherein the means for establishing the first path includes switch means and an impedance of low value and high power handling capability.

16. Apparatus according to claim 15 wherein the said low value impedance is a variable and controllable impedance.

17. Apparatus according to claim 16 which includes means for increasing the impedance of said low value impedance, in a controlled manner, so that once the arc between the components has been extinguished the voltage across the components may be increased to a value which is consistent with a high power operating level of the furnace under operating conditions which do not readily give rise to the generation of unwanted arcing.

18. Apparatus according to claim 11 wherein the said components are selected at least from the following:

(a) the electrode of the furnace and a seal of the furnace;

(b) the electrode and a centre ring of the furnace; and (c) the electrode and conductive pins which are embedded in the roof of the furnace.

* * * * *